US010174888B1

(12) United States Patent
Narushima et al.

(10) Patent No.: US 10,174,888 B1
(45) Date of Patent: Jan. 8, 2019

(54) MODULAR LIGHTING UNIT

(71) Applicant: KOITO ELECTRIC INDUSTRIES, LTD., Shizuoka (JP)

(72) Inventors: Hidekazu Narushima, Shizuoka (JP); Youmei Kaminaga, Sizuoka (JP)

(73) Assignee: KOITO ELECTRIC INDUSTRIES, LTD., Shizuoka (JP)

( * ) Notice: Subject to any disclaimer, the term of this patent is extended or adjusted under 35 U.S.C. 154(b) by 0 days.

(21) Appl. No.: 15/690,527

(22) Filed: Aug. 30, 2017

(51) Int. Cl.

| | |
|---|---|
| ***F21S 2/00*** | (2016.01) |
| ***F21V 21/005*** | (2006.01) |
| ***F21V 15/01*** | (2006.01) |
| ***F21V 19/00*** | (2006.01) |
| ***F21V 21/14*** | (2006.01) |

(52) U.S. Cl.
CPC ..... *F21S 2/005* (2013.01); *F21V 15/01* (2013.01); *F21V 21/005* (2013.01); *F21V 19/002* (2013.01); *F21V 19/0015* (2013.01); *F21V 21/14* (2013.01)

(58) Field of Classification Search
CPC ..... F21S 2/005; F21V 21/005; F21V 21/14; F21V 19/002; F21V 19/0015
See application file for complete search history.

(56) References Cited

U.S. PATENT DOCUMENTS

2003/0147252 A1 8/2003 Fioravanti
2011/0063849 A1* 3/2011 Alexander ..... F21V 19/001 362/294
2012/0049733 A1* 3/2012 Gallai ..... F21V 19/001 315/32
2014/0063814 A1* 3/2014 McGowan ..... F21V 7/00 362/308
2015/0062948 A1 3/2015 Otsubo

FOREIGN PATENT DOCUMENTS

JP 2003-260975 A 9/2003
JP 2015-050173 A 3/2015

* cited by examiner

*Primary Examiner* — Laura Gudorf
(74) *Attorney, Agent, or Firm* — Kubotera & Associates, LLC

(57) ABSTRACT

Problem: To provide a modular lighting unit that allows freely designing a lighting fitting in accordance with the demand for illumination design of the user, and moreover that can be easily assembled, resulting from the simple structure thereof, whereby the cost can be substantially reduced, and its commercial value is high.
Solution: A modular lighting unit 10, including one light emitting element 42 disposed in a lamp chamber that is enclosed by a case 20 and a cover 30, the case 20 and the cover 30 being combined with each other in such a way that the peripheral wall 31 of the cover 30 covers the peripheral wall 21 of the case 20, and in the mutually combined state, they being fixed to each other with an engaging part 34 provided for either one of them being engaged with an engaged part 24 provided for the other by snap fitting. Between the light emitting element 42 and the irradiation aperture 33*a*, there being disposed a lens body 50. A plurality of types of lens bodies 50 that emit the light originated from the LED 42 in different light distribution patterns are previously prepared, and an appropriate one is selected from among them.

10 Claims, 13 Drawing Sheets

10···MODULAR LIGHTING UNIT
20···CASE
21···PERIPHERAL WALL
22···OPENING PART
23···BOTTOM FACE PART
24···ENGAGED PART
30···COVER
31···PERIPHERAL WALL
32···OPENING PART
33···FRONT FACE PART
33a···IRRADIATION APERTURE
34···ENGAGING PART
40···LIGHT SOURCE
41···LED SUBSTRATE
42···LED
50···LENS BODY
51···SUBSTRATE
52···FRONT FACE PART

10···MODULAR LIGHTING UNIT
20···CASE
21···PERIPHERAL WALL
22···OPENING PART
23···BOTTOM FACE PART
24···ENGAGED PART
30···COVER
31···PERIPHERAL WALL
32···OPENING PART
33···FRONT FACE PART
33a···IRRADIATION APERTURE
34···ENGAGING PART
40···LIGHT SOURCE
41···LED SUBSTRATE
42···LED
50···LENS BODY
51···SUBSTRATE
52···FRONT FACE PART

MODULAR LIGHTING UNIT

BACKGROUND OF THE INVENTION

Field of the Invention

The present invention relates to a modular lighting unit in which one light emitting element is disposed in a lamp chamber that is enclosed with a case and a cover.

Description of the Related Art

As a conventional lighting fitting that is applicable to, for example, a headlight disposed in the front part of a railroad vehicle, a lamp unit for vehicle that is disclosed in Patent Document 1 is known. This lamp unit for vehicle is comprised of a light source with which a plurality of LEDs are mounted on one substrate, being arranged in a predetermined orientation, a multi-faced reflector that is assembled with the light source to reflect the light originated from the respective LEDs forward, and a transparent cover.

With the above-mentioned lamp unit for vehicle, a light source including a plurality of (nine, for example) LEDs, that are mounted on an elongated rectangular substrate in a line is provided as a unit. In the front part of a railroad vehicle, a lamp housing portion for housing a lamp for vehicle is formed as a recess according to the design shape of the outer wall thereof, and the lamp for vehicle is disposed in the lamp housing portion.

By the way, in recent years, as the design shape of the railroad vehicle is diversified, a higher degree of freedom of illumination design is also demanded for the headlight. However, since the conventional lamp for vehicle has a structure in which a plurality of LEDs are mounted on one substrate, it has been impossible to alter the disposed location of each individual LED, or the geometry of the entire substrate; therefore in many cases, a particular illumination design that is demanded could not have been implemented. Also, it has been impossible to dispose each individual LED three-dimensionally rather than on the same plane.

As a light source that can solve such problems, the optical element as disclosed in Patent Document 2 is known. Basically, this optical element provides a lamp chamber that is enclosed by a cup-shaped component and a cylindrical component, having one LED therein, and individual optical elements can be freely combined to be disposed.

With the above-mentioned optical element, a substrate for the LED is fixedly attached to the bottom of the cup-shaped component, and a lens is fixedly attached to the cylindrical component. In addition, the cylindrical component is fixedly attached to the cup-shaped component with an optical guide and others being also disposed in the hollow portion thereof. The above-mentioned fixedly attaching of one part to another is performed by bonding.

Patent Document 1: Japanese Unexamined Patent Application Publication No. 2015-50173

Patent Document 2: Japanese Unexamined Patent Application Publication No. 2003-260975

However, with the prior art as disclosed in the above-mentioned Patent Document 2, not only the number of parts of an optical element is large, but also the parts must be separately bonded to one another in assembling the optical element. In this way, there has been a problem that, for assembling an optical element, not only the man-hour is increased, but also the bonding operation is troublesome, requiring a lot of time, resulting in an increased cost.

The present invention has been made in view of the above-mentioned problems that the conventional technology has presented, and is intended to provide a modular lighting unit that allows freely designing a lighting fitting in accordance with the demand for illumination design of the user, and moreover that can be easily assembled, resulting from the simple structure thereof, whereby the cost can be substantially reduced, and its commercial value is high.

SUMMARY OF THE INVENTION

The subject matters of the present invention to achieve the above intention are disclosed in the following respective aspects of the present invention:

[1] A modular lighting unit (10), including one light emitting element (42) disposed in a lamp chamber that is enclosed by a case (20) and a cover (30), the case (20) and the cover (30) being combined with each other in such a way that the peripheral wall (31) of the cover (30) covers the peripheral wall (21) of the case (20), and in the mutually combined state, they being fixed to each other with an engaging part (34) provided for either one of them being engaged with an engaged part (24) provided for the other by snap fitting, in the front face part (33) of the cover (30), there being formed an irradiation aperture (33*a*) for irradiating the light originated from the light emitting element (42), between the light emitting element (42) and the irradiation aperture (33*a*), there being disposed a lens body (50) that distributes the light made incident from the light emitting element (42) thereon in a previously designed range or a predetermined direction, and the lens body (50) being a lens body that has been selected from among a plurality of types of the lens bodies (50) that have been previously prepared, the plurality of types of the lens bodies (50) emitting the light originated from the light emitting element (42) in different light distribution patterns.

[2] The modular lighting unit (10) according to [1], wherein the front face part (52) of the lens body (50) closes the irradiation aperture (33*a*), being matched thereto, and behind the front face part (52), there are provided leg parts (55) for supporting the front face part (52) in a predetermined location in the lamp chamber, the lens body (50) being held in the state in which the front face part (52) thereof is pressed against the front face part (33) of the cover (30), thereby the lens body (50) pressing the light emitting element (42) against the inner face of a bottom wall in the bottom face part (23) of the case (20) through the leg parts (55).

[3] The modular lighting unit (10) according to [1] or [2], wherein the orientation in which the lens body (50) is to be assembled, upon it being disposed in the case (20), is predetermined, and in the lens body (50) and the case (20), there is provided with an orientation regulating means (22*a*, 51*a*) for regulating the orientation in which assembling of one with the other is performed.

[4] The modular lighting unit (10) according to [1], [2] or [3], wherein an annular packing formed of an elastic material is interposed between the inner circumferential edge of the irradiation aperture (33*a*) in the front face part (33) of the cover (30) and the front face part (52) of the lens body (50), the cover (30) and the lens body (50) being tightly contacted with each other through the packing.

[5] The modular lighting unit (10) according to [1], [2], [3] or [4], wherein, along the end edge of the opening part (32) located at the rear end of the peripheral wall (31) of the cover (30), there are provided a plurality of the engaging parts (34) at predetermined intervals, along the outer periphery of the bottom face part (23) on the side opposite to the opening part (22) located at the front end of the peripheral wall (21) of the case (20), a plurality of the engaged parts (24) being provided in locations corresponding to those of the respective engaging parts (34)

[6] The modular lighting unit (10) according to [1], [2], [3], [4] or [5], wherein the respective peripheral walls (21, 31) of the case (20) and the cover (30) are formed into a shape of an polygonal cross section, and of a plurality of side face walls that line up in a peripheral direction, a pair of side face walls that are opposite to each other are provided with an engaging part (34) or an engaged part (24).

[7] The modular lighting unit (10) according to [1], [2], [3], [4], [5] or [6], wherein the outer peripheral wall surface of the peripheral wall (21) of the case (20) has a tapered shape with which the diameter is gradually reduced from the bottom face part (23) located at the rear end toward the opening part (22) thereahead, while the inner peripheral wall surface of the peripheral wall (31) of the cover (30) has a tapered shape with which the diameter is gradually increased from the front face part (33), where the light originated from the light emitting element (42) is irradiated, to the opening part (32) therebehind, by bringing the respective opening parts (22, 32) close to each other, the case (20) and the cover (30) being assembled to each other, being guided by the tapered shape.

[8] The modular lighting unit (10) according to [1], [2], [3], [4], [5], [6], or [7], wherein the cover (30) is provided with an engaging claw as the engaging part (34), and the case (20) is provided with an engaged groove as the engaged part (24) into which the tip of the engaging claw is fitted, the engaging claw being provided with a tapered shape that allows it to be slid on the outer peripheral wall surface of the peripheral wall (21) of the case (20), being elastically contacted therewith, until fitted into the engaged groove.

[9] The modular lighting unit (10) according to [1], [2], [3], [4], [5], [6], [7], or [8], wherein the light emitting element (42) is one LED that is mounted on the LED substrate (41), on the inner face of the bottom wall in the bottom face part (23) of the case (20), there being provided a locating means (23*c*) for properly locating the LED substrate (41) upon disposing it in the bottom face part.

[10] The modular lighting unit (10) according to [9], wherein, between the inner face of the bottom wall in the bottom face part (23) of the case (20) and the LED substrate (41), there is interposed a non-conductive sheet (60) made up of an insulating material, the non-conductive sheet (60) being also located together with the LED substrate (41) with the use of the locating means (23*c*).

Next, the function on the basis of the above-described means for solving the problems will be explained.

The modular lighting unit (10) according to the above [1] provides a minimum unit of lighting fitting, including one light emitting element (42) being disposed in a lamp chamber that is enclosed by the case (20) and the cover (30). A plurality of such modular lighting units (10) are arranged in a configuration according to a desired illumination design to constitute a lighting fitting. Accordingly, diversification of the illumination design of the lighting fitting can be easily accommodated, whereby the number of variations in configuration of the lighting fitting can be increased.

With such a modular lighting unit (10), the case (20) and the cover (30) are combined with each other in such a way that the peripheral wall (31) of the cover (30) covers the peripheral wall (21) of the case (20). Herein, in the state in which the case (20) the cover (30) are combined with each other, they are fixed to each other with an engaging part (34) provided for either one of them being engaged with an engaged part (24) provided for the other by snap fitting. Accordingly, with no need for using a fixing means, such as an adhesive or a screw, the case (20) and the cover (30) can be easily assembled with each other simply by utilizing their structures.

In the front face part (33) of the cover (30), an irradiation aperture (33*a*) for irradiating the light originated from the light emitting element (42) is formed, and between this irradiation aperture (33*a*) and the light emitting element (42), there is disposed a lens body (50) that distributes the light made incident from the light emitting element (42) thereon in a previously designed range or a predetermined direction. With this lens body (50), the light having a desired light distribution pattern can be obtained from the modular lighting unit (10).

Herein, a plurality of types of lens bodies (50) that emit the light originated from the light emitting element (42) in different light distribution patterns are previously prepared, and an appropriate one is selected from among them. For example, if there are prepared two different types of modular lighting units (10), i.e., one using a lens body (50A) for distance irradiating and the other using a lens body (50B) for adjacency irradiating, these two types of modular lighting units (10) can be freely combined to implement a lighting fitting according to a desired light distribution pattern easily.

In addition, with the modular lighting unit (10) according to the above [2], the front face part (52) of the lens body (50) closes the irradiation aperture (33*a*), being matched thereto, and thus there is no need for separately preparing a transparent protection cover, or the like, that covers the irradiation aperture (33*a*), whereby the number of components can be reduced. The lens body (50) is also provided with leg parts (55) which support the front face part (52) of the (50) in a predetermined location in the lamp chamber.

Herein, the lens body (50) is held in the state in which the front face part (52) thereof is pressed against the front face part (33) of the cover (30), thereby the lens body (50) pressing the light emitting element (42) against the inner face of the bottom wall in the bottom face part (23) of the case (20) through the leg parts (55). In other words, the operation of fixing the case (20) and the cover (30) to each other by the snap-fitting engagement will automatically cause the lens body (50) and the light emitting element (42) to be held in the respective predetermined locations in the lamp chamber, thereby there being no need for using an adhesive, or the like, to fix them.

As stated in the above [3], in the case where the orientation in which the lens body (50) is to be assembled with the case (20) is predetermined, there may be provided with an orientation regulating means (22*a*, 51*a*) in the lens body (50) and the case (20) for regulating the orientation in which assembling of one with the other is performed. Thereby, the proper orientation can be easily identified, whereby assembling in a wrong orientation can be avoided.

Further, with the modular lighting unit (10) according to the above [4], an annular packing (70) formed of an elastic material is interposed between the inner circumferential edge of the irradiation aperture (33*a*) in the front face part of the cover (30) and the front face part (52) of the lens body (50), the cover (30) and the lens body (50) being tightly contacted with each other through the packing (70). In this way, the packing (70) can prevent dirt and dust from entering the lamp chamber, however, the packing (70) can be provided with not only such a dirt and dust proofing property, but also a waterproofing property, as needed.

The engaging part (34) and the engaged part (24), which are engaged to each other by snap fitting, may be disposed as stated in the above [5]. In other words, a plurality of the engaging parts (34) of the cover (30) are provided at predetermined intervals along the end edge of the opening part (32) located at the rear end of the peripheral wall (31) of the cover (30). On the other hand, a plurality of the engaged parts (24) of the case (20) are provided in locations corresponding to those of the respective engaging parts (34) along the outer periphery of the bottom face part (23) of the case (20). With such an arrangement of the engaging parts (34) and the engaged parts (24), they can be easily formed, and they are free from the possibility of interfering with any other components.

More specifically, as stated in the above [6], in the case where the peripheral wall (21, 31) of the case (20) and the cover (30) is formed into a shape having an polygonal cross section, of a plurality of side face walls that line up in a peripheral direction, a pair of side face walls that are opposite to each other may be provided with an engaging part (34) or an engaged part (24). Herein, two or more pairs of side face walls that are opposite to each other may be provided with a plurality of engaging parts (34) or engaged parts (24). In this way, a sufficiently high fixing strength can be provided.

With the modular lighting unit (10) as stated in the above [7], the outer peripheral wall surface of the peripheral wall (21) of the case (20) is provided with a tapered shape with which the diameter is gradually reduced from the bottom face part (23) located at the rear end toward the opening part (22) thereahead. In addition, the inner peripheral wall surface of the peripheral wall (31) of the cover (30) is provided with a tapered shape with which the diameter is gradually increased from the front face part (33) to the opening part (32) therebehind. In this way, by bringing the case (20) and the cover (30) close to each other in a coaxial direction such that the respective opening parts (22, 32) are aligned to each other, the case (20) and the cover (30) can be easily assembled to each other, being guided by the tapered shape.

Herein, as stated in the above [8], the engaging part (34) of the cover (30) is provided as an engaging claw, and the case (20) of the engaged part (24) is provided as an engaged groove into which the tip of the engaging claw is fitted, further a contrivance being added to the engagement of these with each other. In other words, the engaging claw is provided with a tapered shape that allows it to be slid on the outer peripheral wall surface of the peripheral wall (21) of the case (20), being elastically contacted therewith, until fitted into the engaged groove, whereby, following the operation of aligning the opening parts (22, 32) of the case (20) and the cover (30), the snap-fitting engagement can be completed with no need for any extra work.

In addition, with the modular lighting unit (10) as stated in the above [9], the light emitting element (42) is one LED (42) that is mounted on the LED substrate (41), and on the inner face of the bottom wall in the bottom face part (23) of the case (20), there is provided a locating means (23*c*) for properly locating the LED substrate (41) upon disposing it in the bottom face part (23). In this way, the light source (40) can be easily disposed in the lamp chamber. There is no need for fixing the LED substrate (41) to the bottom face part (23) of the case (20)

Herein, as stated in the above [10], in the case where, between the inner face of the bottom wall in the bottom face part (23) of the case (20) and the LED substrate (41), there is interposed a non-conductive sheet (60) made up of an insulating material, the non-conductive sheet (60) may also be located together with the LED substrate (41) with the use of the locating means (23*c*).

With the modular lighting unit according to the present invention, a plurality of modular lighting units can be arranged in a configuration according to a desired illumination design to constitute a lighting fitting, whereby a lighting fitting that meets the demand for illumination design of the user can be freely designed.

Moreover, the case and the cover can be fixed to each other by snap fitting engagement, whereby the modular lighting unit according to the present invention can be easily assembled, resulting from the simple structure thereof, and thus the cost can be substantially reduced.

In addition, the lens body (50) is selected from among a plurality of types of the lens bodies (50) that have been previously prepared, the plurality of types of the lens bodies (50) emitting the light originated from the light emitting element (42) in different light distribution patterns, whereby a lighting fitting according to a desired light distribution pattern can be easily implemented.

DETAILED DESCRIPTION OF THE PREFERRED EMBODIMENT

Hereinbelow, an embodiment representing the present invention will be explained with reference to the drawings.

FIG. 1 to FIG. 17 show one embodiment of the present invention.

A modular lighting unit 10 according to the present embodiment is implemented as a minimum unit of lighting fitting, an LED 42, which is one light emitting element, being disposed in a lamp chamber that is enclosed by a case 20 and a cover 30.

Figure 1:
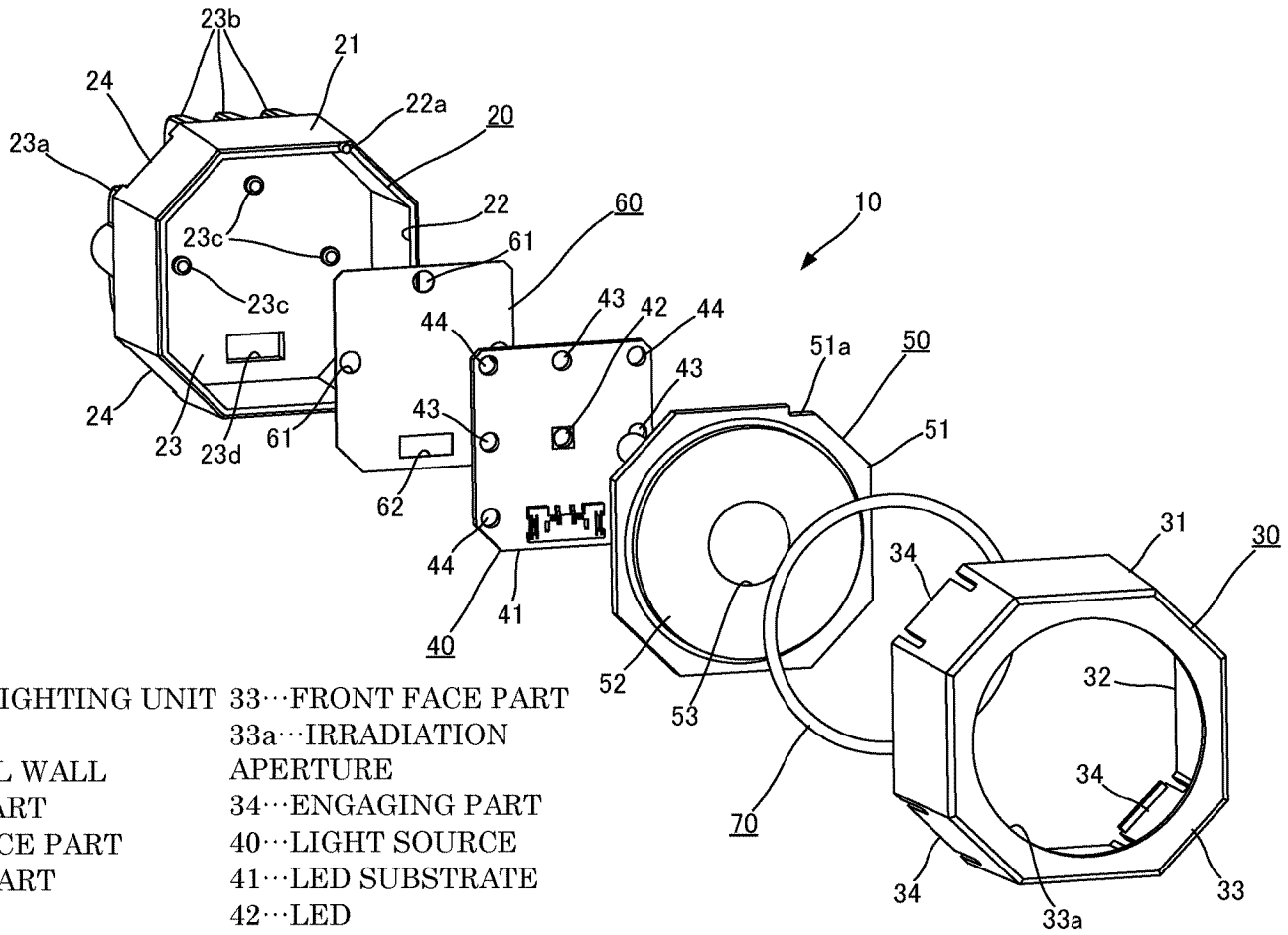
FIG. 1 is a perspective side view of the modular lighting unit according to an embodiment of the present invention, being shown from the front side in the disassembled state.
Figure 2:
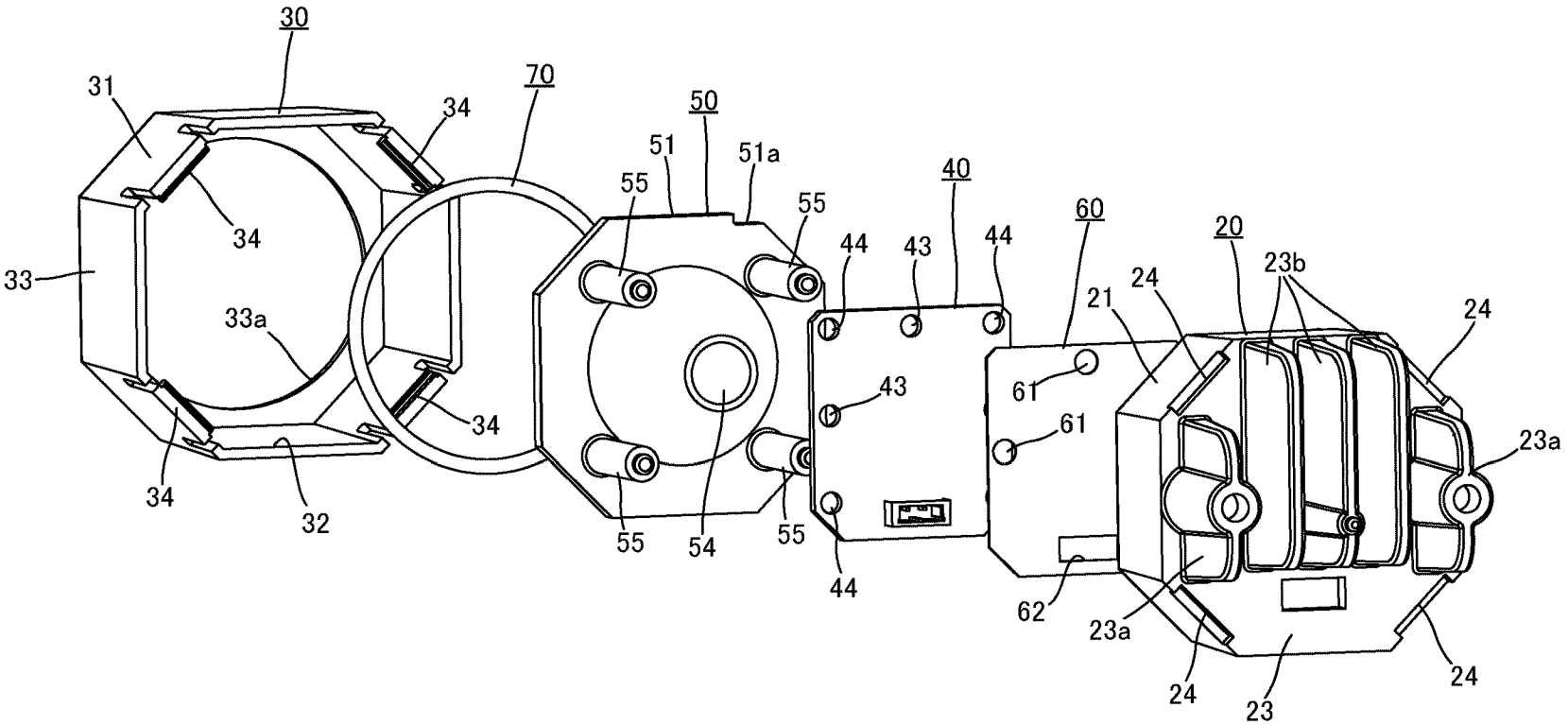
FIG. 2 is a perspective side view of the modular lighting unit according to an embodiment of the present invention, being shown from the rear side in the disassembled state.
Figure 3:
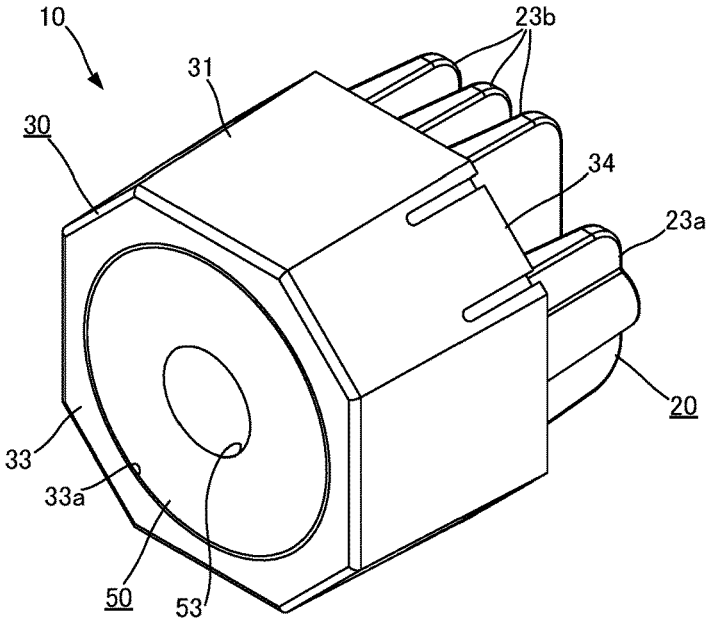
FIG. 3 is a perspective side view of the modular lighting unit according to an embodiment of the present invention, being shown from the front side.
Figure 4:
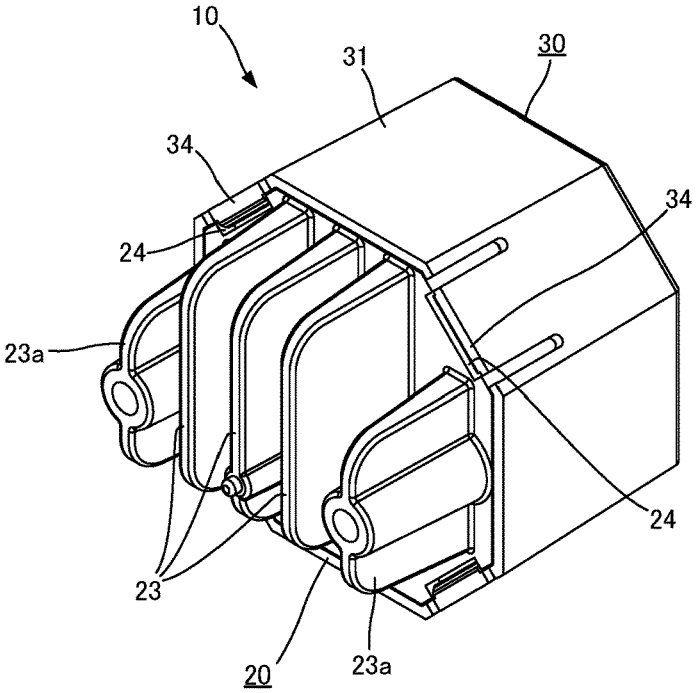
FIG. 4 is a perspective side view of the modular lighting unit according to an embodiment of the present invention, being shown from the rear side.
Figure 5:
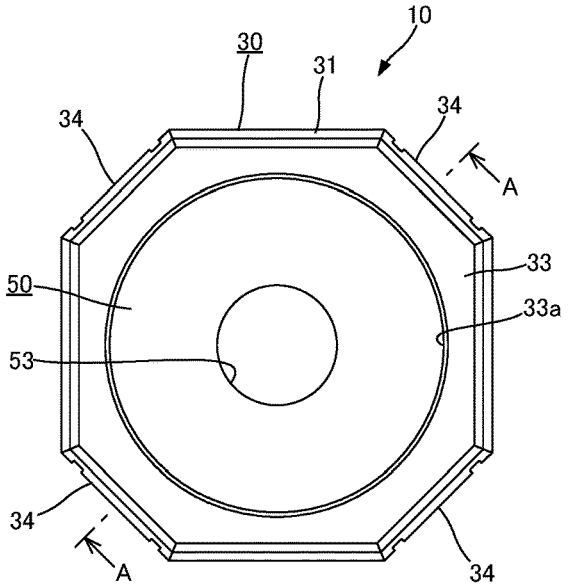
FIG. 5 is a front view of the modular lighting unit according to an embodiment of the present invention.
Figure 6:
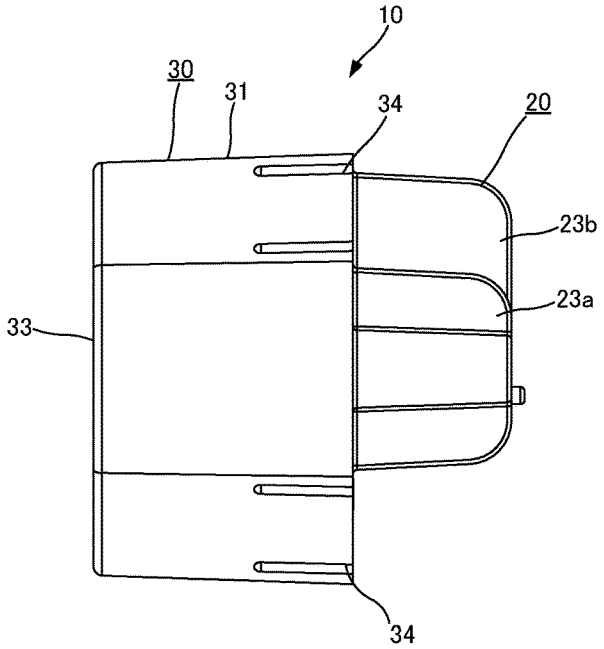
FIG. 6 is a side view of the modular lighting unit according to an embodiment of the present invention.
Figure 7:
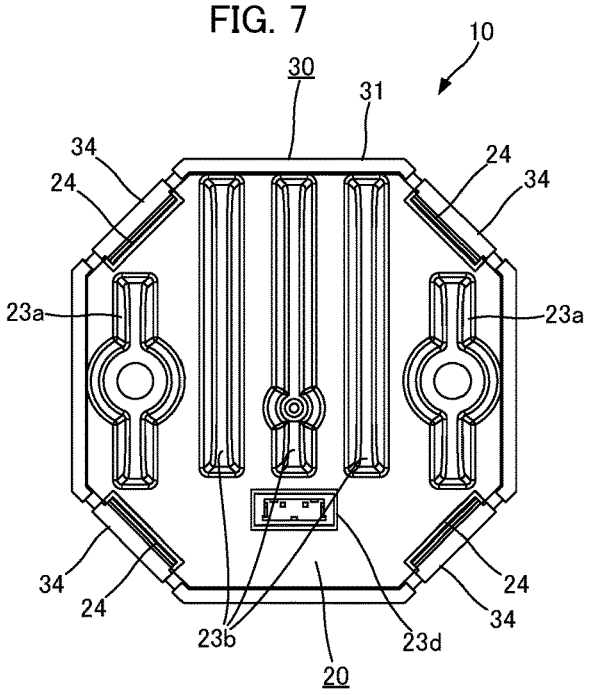
FIG. 7 is a rear view of the modular lighting unit according to an embodiment of the present invention.
Figure 8:
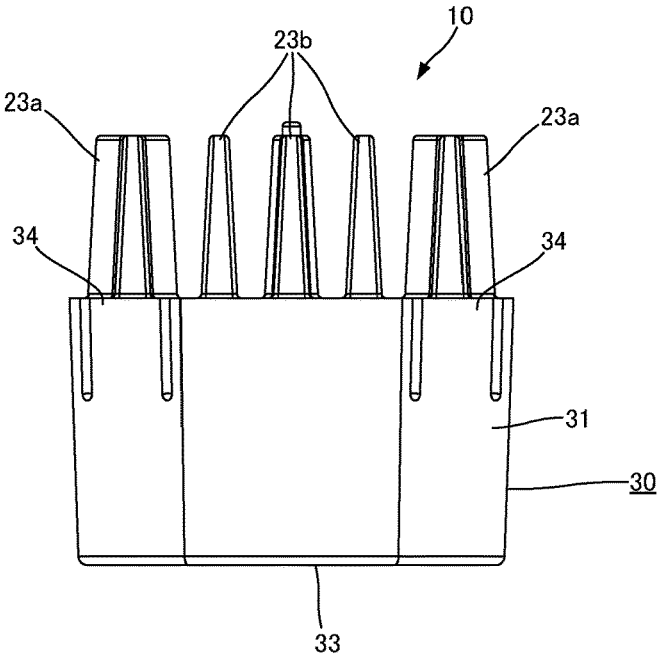
FIG. 8 is a plan view of the modular lighting unit according to an embodiment of the present invention.

The modular lighting unit 10 as shown in FIG. 1 and FIG. 2 is basically comprised of a case 20, a cover 30, a light source 40, and a lens body 50. These components are assembled to one another with no need for using an adhesive, screws, or the like, resulting from the snap-fitting engagement between the case 20 and the cover 30. In other words, the case 20 and the cover 30 are combined to each other in such a way that a peripheral wall 31 of the cover 30 covers a peripheral wall 21 of the case 20, and are fixed to each other in the mutually combined state with an engaging part provided in either one of them being engaged with an engaged part provided in the other one by snap fitting.

Figure 9:
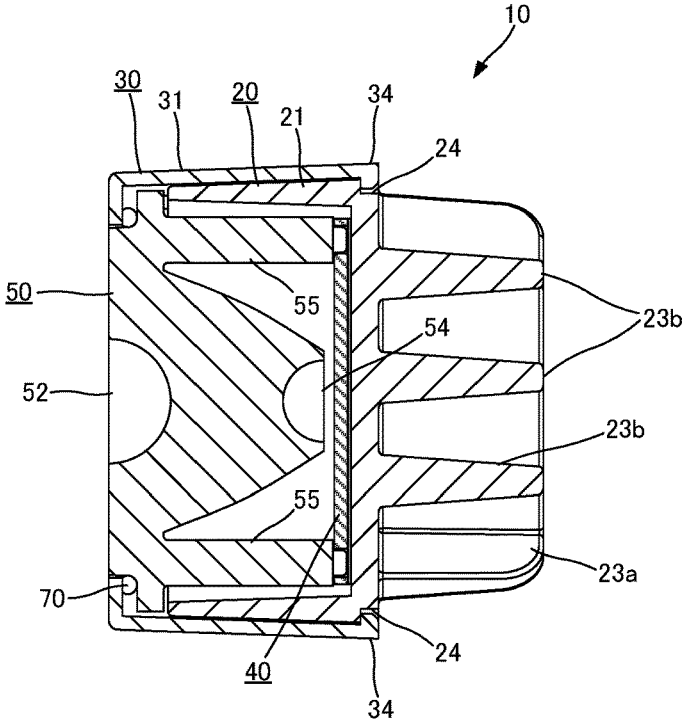
FIG. 9 is a sectional view along the line A-A in FIG. 5.
Figure 10:
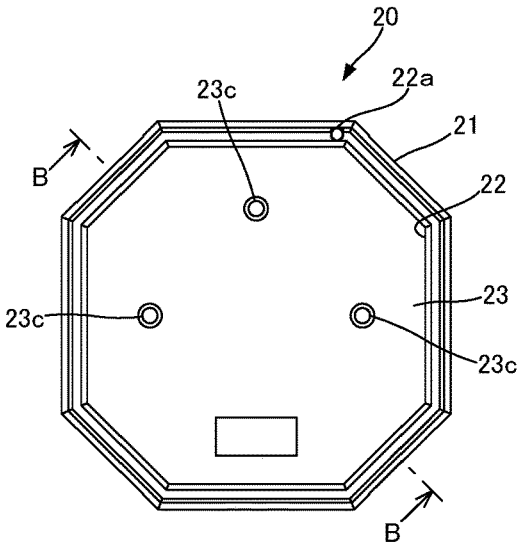
FIG. 10 is a front view showing a case of the modular lighting unit according to an embodiment of the present invention.

The case 20 is integrally formed by die casting, or the like, from a metal, such as an aluminum alloy. The case 20 is formed, as a whole, into a cylindrical shape, being provided with a peripheral wall 21 having an octagonal cross section. The front end of the peripheral wall 21 provides an opening part 22, and the rear end thereof on the opposite side of the opening part 22 is closed as a bottom face part 23. In addition, as shown in FIG. 9, the outside surface of the peripheral wall 21 (the outer peripheral wall surface) of the case 20 is formed into a tapered shape with which the diameter is gradually reduced from the bottom face part 23 toward the opening part 22, which is located ahead thereof.

On the outer surface of the bottom wall in the bottom face part 23 of the case 20, there are erected a plurality of heat radiating fins 23*a* and 23*b*, which extend in parallel to one another and rearward, thus the case 20 also serving as a heat sink. Of the plurality of heat radiating fins 23*a* and 23*b*, a pair of heat radiating fins 23*a*, which are shorter, being disposed on the outermost side, are provided with a mounting hole for screw fastening. In the bottom face part 23, an insertion hole 23*d* for passing wires to supply power from an external power supply is provided in an appropriate place.

In the case 20, there is provided an engaged part 24, with which the later-described cover 30 is engaged by snap fitting. A plurality of engaged parts 24 are disposed such that they are arranged at predetermined intervals along the outer periphery of the bottom face part 23. In the present embodiment, the peripheral wall 21 of the case 20 is formed into a shape having an octagonal cross section, and of the plurality of side face walls of the peripheral wall 21 that line up in a peripheral direction, two pairs of side face walls that are opposite to each other, in other words, four side face walls in total are provided with an engaged part 24, respectively, at the rear end thereof.

Figure 11:
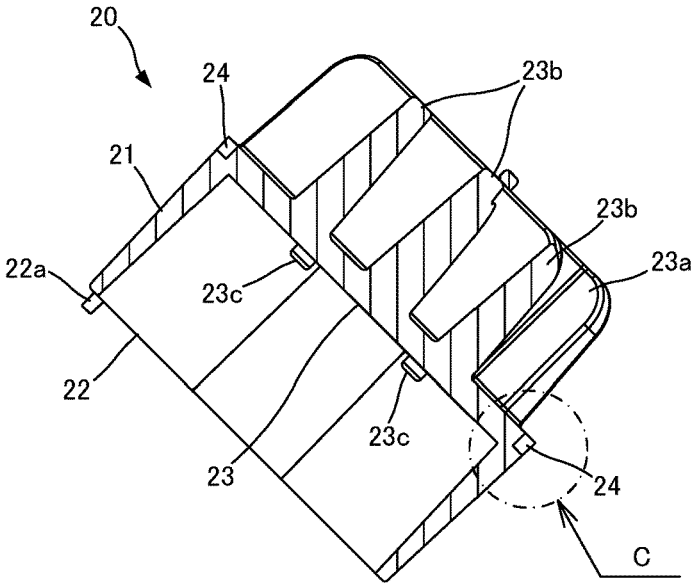
FIG. 11 is a sectional view along the line B-B in FIG. 10.
Figure 12:
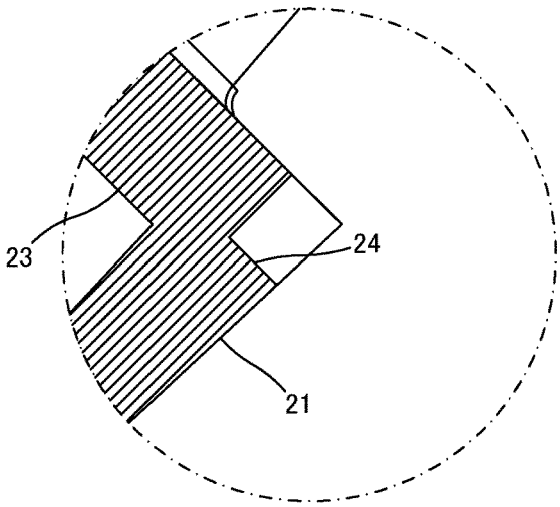
FIG. 12 is an enlarged view of the portion C in FIG. 11.
Figure 13:
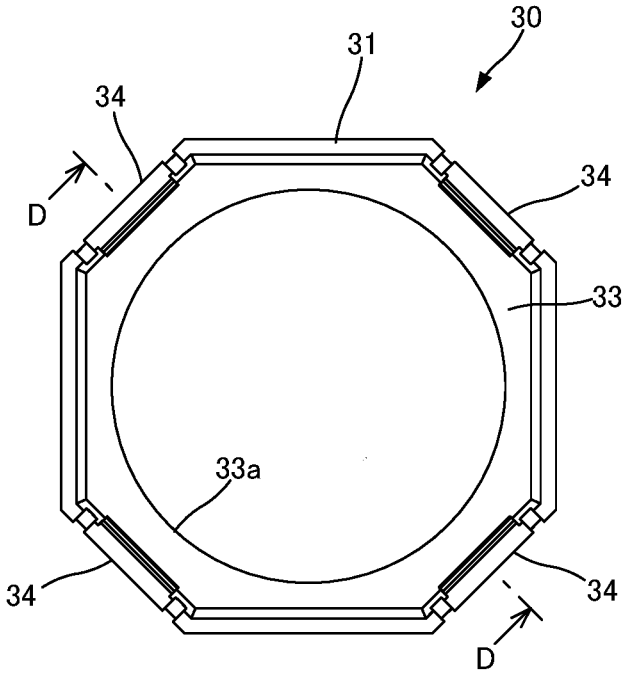
FIG. 13 is a front view showing a cover of the modular lighting unit according to an embodiment of the present invention.

Specifically, as shown in FIG. 11, the engaged part 24 is provided at the rear end of the side face wall as an engaged groove into which the tip of the engaging claw of the engaging part 34 of the later-described cover 30 is just fitted. Such an engaged groove has a geometry that is given by notching the corner of the rear end of the side face wall at right angles as shown in FIG. 12 as an enlarged view.

Next, the cover 30 is integrally formed of a synthetic resin, such as a plastic, using a mold. Being made correspondent to the case 20, the cover 30 is also formed, as a whole, into a cylindrical shape, being provided with a peripheral wall 31 having an octagonal cross section. The rear end of the peripheral wall 31 provides an opening part 32, and in a front face part 33, which is on the side opposite to the opening part 32, an irradiation aperture 33*a* in a circular shape for irradiating the light originated from the light source 40 to the outside is largely formed.

As shown in FIG. 9, the inside surface of the peripheral wall 31 (the inner peripheral wall surface) of the cover 30 is formed into a tapered shape with which the diameter is gradually increased from the front face part 33 toward the opening part 32, which is located behind thereof. The inside diameter of the cover 30 is designed so as to tightly fit to the outside diameter of the case 20, and by bringing the cover 30 and the case 20 close to each other in a coaxial direction such that the respective opening parts 32 and 22 are aligned to each other, the cover 30 and the case 20 are easily assembled to each other, being guided by the tapered shape. The internal space enclosed by these cover 30 and case 20 provides a lamp chamber.

In the cover 30, there is provided an engaging part 34, with which the case 20 is engaged by snap fitting. A plurality of engaging parts 34 are disposed along the end edge of the opening part 32 in such a way that they are arranged in locations corresponding to those of the engaged parts 24. In the present embodiment, the peripheral wall 31 of the cover 30 is formed into a shape having an octagonal cross section, as with the case 20, and of the plurality of side face walls of the peripheral wall 31 that line up in a peripheral direction, two pairs of side face walls that are opposite to each other, in other words, four side face walls in total are provided with an engaging part 34, respectively, at the rear ends thereof, which are located at the end edge of the opening part 32.

Figure 14:
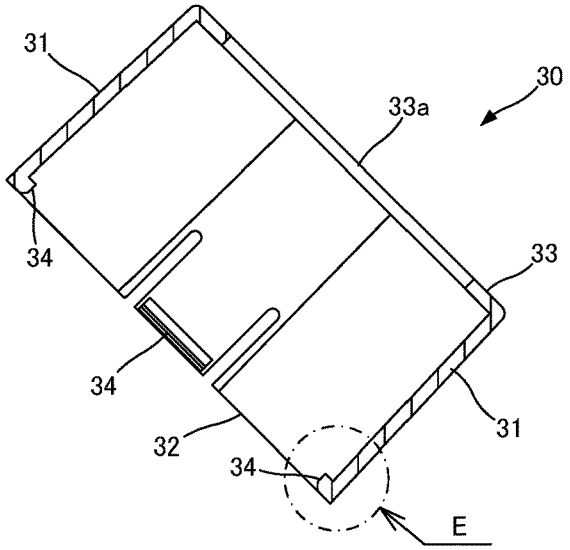
FIG. 14 is a sectional view along the line D-D in FIG. 13.
Figure 15:
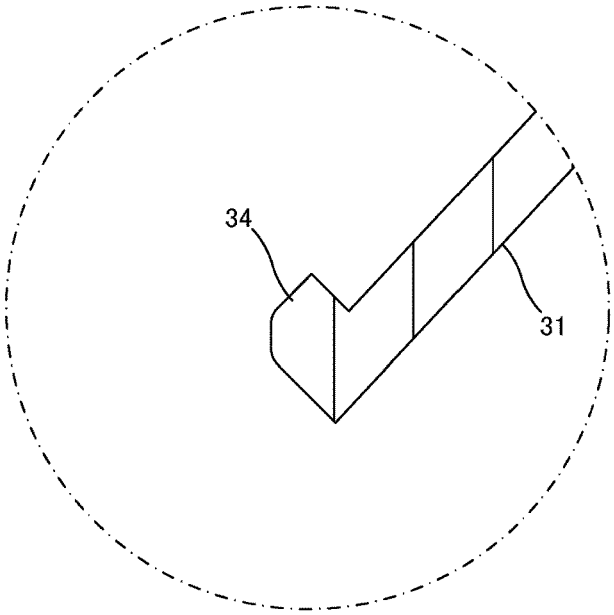
FIG. 15 is an enlarged view of the portion E in FIG. 14.
Figure 16:
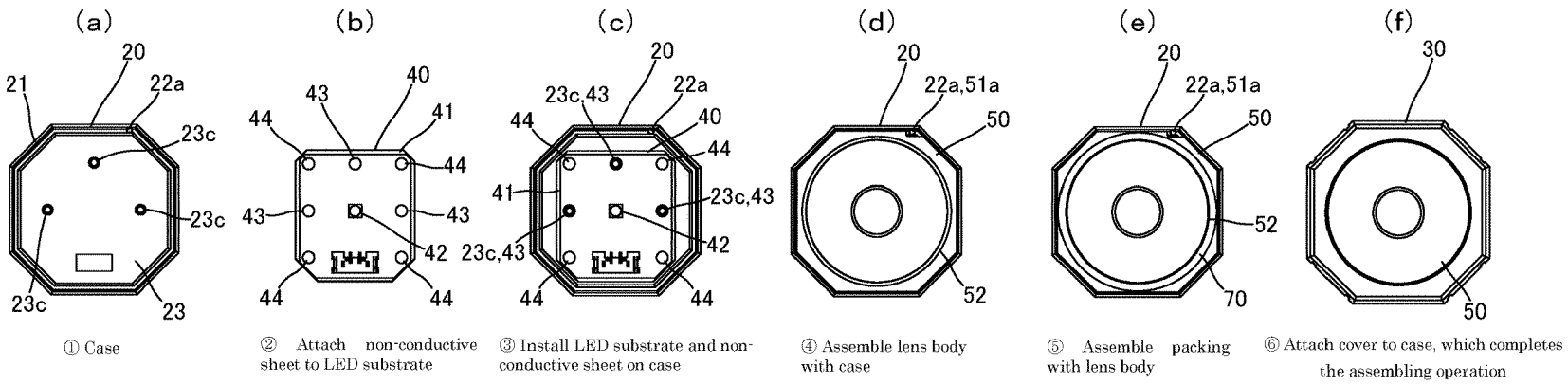
FIG. 16 is an explanatory drawing illustrating the steps of assembling the modular lighting unit according to an embodiment of the present invention.

Specifically, as shown in FIG. 14, the engaging part 34 is provided as an engaging claw at the end edge of the opening part 32 that is just fitted into the engaged part 24 of the case 20, i.e., the engaged groove. Such an engaging claw has a geometry that is given by projecting the tip of the claw in a direction from the end edge of the opening part 32 toward the inside thereof as shown in FIG. 15 as an enlarged view. Herein, the front face of the tip of the claw is provided with a tapered shape that allows the tip of the claw to be slid on the outer peripheral wall surface of the case 20, being elastically contacted therewith, until fitted into the engaged groove. In addition, as shown in FIG. 1, on both sides of the engaging part 34, a pair of slits are notched such that a portion of the side face wall which includes the engaging part 34 can be elastically deformed toward the outside.

Next, the light source 40 is prepared by mounting a single LED 42 as a light emitting element on an LED substrate 41, which is rectangular, having a size that allows it to be accommodated on the inner surface of the bottom wall in the bottom face part 23 of the case 20. Herein, as the LED 42, a surface mounting type LED chip is suitable, for example.

Since the LED chip is general, and thus detailed explanation will be omitted, but it is of such a type that light is emitted within the radiation range of a predetermined angle around the optical axis that is perpendicular to the LED substrate 41. The luminescent color can be arbitrarily selected, depending upon the application for the lighting fitting and the type thereof, and being not limited to white, which is suited for the headlight of railroad vehicles, if red is selected, for example, the modular lighting unit according to the present embodiment is also applicable to taillights, automotive braking lamps, and the like.

In the lamp chamber, the LED substrate 41 is required to be held in a predetermined location where it is contacted with the inner face of the bottom wall in the bottom face part 23 of the case 20, and thus on the inner face of the bottom wall of the bottom face part 23, there is provided a locating means for properly locating the LED substrate 41 when disposing it in the bottom face part 23. In other words, as shown in FIG. 1, the inner face of the bottom wall in the bottom face part 23 is provided with three projections 23*c*, while, in the peripheral area of the LED substrate 41, there are provided three hole parts 43 that are fitted to the respective projections 23*c*. In addition, at the four corners of the LED substrate 41, there are also provided hole parts 44 for locating the later-described lens body 50.

In addition, between the inner face of the bottom wall in the bottom face part 23 of the case 20 and the LED substrate 41, there is interposed a non-conductive sheet 60. The non-conductive sheet 60 is produced by working an insulating material in the form of a sheet, such as a silicone rubber, such that it has the same shape as the LED substrate 41. The non-conductive sheet 60 is a member that serves to protect the circuit on the LED substrate 41 as a cushioning material, and to enhance the heat dissipation capability by raising the adhesiveness between the bottom face part 23 of the case 20 and the LED substrate 41.

The non-conductive sheet 60 is also located together with the LED substrate 41 with the above-mentioned locating means. In other words, as shown in FIG. 1, in the peripheral area of the non-conductive sheet 60, there are provided hole parts 61 that are fitted to the respective projections 23*c*. As with the bottom face part 23 of the case 20, the non-conductive sheet 60 is also provided with an insertion hole 62 in an appropriate place for passing wires to supply power from an external power supply.

In addition, between the irradiation aperture 33*a* in the cover 30 and the light source 40 (the LED 42), there is disposed a lens body 50 for distributing the light emitted from the LED 42 within a predetermined range or in a predetermined direction. The lens body 50 is integrally formed of a transparent material, such as an acrylic resin or polycarbonate. As shown in FIG. 1, the lens body 50 is provided with a substrate 51 having an octagonal shape that matches the inside of the front face part 33 of the cover 30, and on the front side of this substrate 51, there is formed a front face part 52 that is in the shape of a disk and is slightly raised from the top of the substrate 51, having a size large enough to match the irradiation aperture 33*a* for closing it.

The surface of the front face part 52 of the lens body 50 serves as a light emission surface for the irradiation light, and in the central portion thereof, there is provided a hole part 53 that is recessed toward the rear face. The bottom face of the hole part 53 is formed into a predetermined lens geometry that determines the light distribution pattern. As shown in FIG. 9, the rear face of the front face part 52 is bulged in the shape of a bowl toward therebehind so as to surround the hole part 53, and a top end part 54 of the bulged portion is formed into a predetermined lens geometry that faces the geometry of the bottom face of the hole part 53.

Herein, the outer peripheral surface of the portion that is bulged in the shape of a bowl provides a critical reflection plane that totally reflects the light made incident from the top end part 54 thereon toward the light emitting surface, and with a specific design of the curved geometry and the inclination angle of the critical reflection plane, the totally reflected light can be irradiated from the light emitting surface in a desired direction or with desired light distribution characteristics. On the basis of such a design, a plurality of types of lens body 50 that emit the light originated from the LED 42 in different light distribution patterns are previously prepared, and an appropriate type of lens body 50 that has been selected from among them is used.

Figure 17:
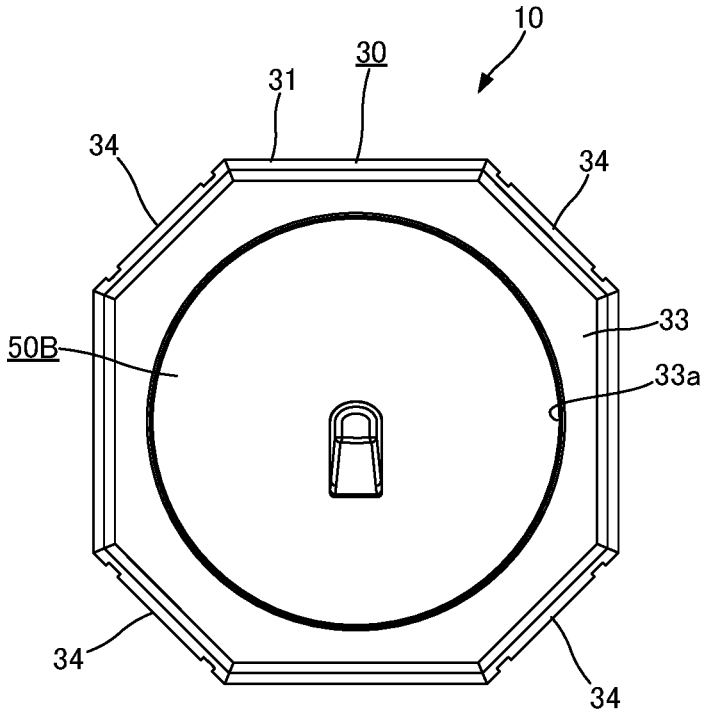
FIG. 17 is a front view illustrating an example in which another type of lens body is used with the modular lighting unit according to an embodiment of the present invention.

In the present embodiment, there have been prepared two different types of lens bodies, i.e., a lens body 50A for distance irradiating (high beam) that irradiates light forward in a direction approximately parallel with the optical axis of the LED 42, and a lens body 50B for adjacency irradiating (low beam) that irradiates light downward in a direction obliquely crossing the optical axis of the LED 42. The lens body 50 that is shown in FIG. 1, FIG. 2, and FIG. 9 is the lens body 50A for high beam, while the lens body 50 shown in FIG. 17 is the lens body 50B for low beam.

The rear face side of the front face part 52 is provided with leg parts 55 for supporting the front face part 52 in a predetermined location in the lamp chamber, in other words, in a location where the top end part 54 is supported in proximity to the LED 42 and perpendicularly thereto. The leg parts 55, the number of which is four, are erected from the four corners of the rear face of the front face part 52. The lens body 50 is held in the state in which the front face part 52 thereof is pressed against the front face part 33 of the cover 30, thereby the lens body 50 pressing the LED substrate 41 against the inner face of the bottom wall in the bottom face part 23 of the case 20 through the four leg parts 55.

Resulting from the above-mentioned predetermined lens geometry, the orientation in which the lens body 50 is to be assembled, upon it being disposed in the case 20, is predetermined. Then, in the lens body 50 and the case 20, there is provided an orientation regulating means for regulating the orientation in which assembling of one with the other is performed. In other words, as shown in FIG. 1, there is provided a notch 51*a* in a place in the outer peripheral edge of the substrate 51 of the lens body 50.

On the other hand, in a place in the peripheral edge of the opening part 22 of the case 20 where the notch 51*a* is to be brought into the corresponding orientation, there is provided a projection 22*a* that is to be inserted into the notch 51*a*. Thereby, in an orientation in which the projection 22*a* will not be aligned to the notch 51*a*, the projection 22*a* interferes with the outer peripheral edge of the substrate 51, thereby the lens body 50 and the case 20 cannot be assembled to each other.

Further, an annular packing 70 is interposed between the inner circumferential edge of the irradiation aperture 33*a* in the cover 30 and the front face part 52 of the lens body 50, thereby the cover 30 and the lens body 50 being tightly contacted with each other through the packing 70. The packing 70 is integrally formed of an elastic material, such as a silicone rubber. The packing 70 can prevent dirt and dust from entering the lamp chamber through a clearance between the cover 30 and the lens body 50, however, it may be adapted to also have a waterproof property in addition to the dirt and dust prevention capability.

Next, the function of the modular lighting unit 10 according to the present embodiment will be explained.

In order to assemble the modular lighting unit 10, the light source 40 must first be disposed on the inner face of the bottom wall in the bottom face part 23 of the case 20 shown in FIG. 16A. As shown in FIG. 16B, the non-conductive sheet 60 (see FIG. 1) is superposed on the rear face of the LED substrate 41 of the light source 40, and then these two component parts are disposed on the inner face of the bottom wall in the bottom face part 23 as shown in FIG. 16C.

On the inner face of the bottom wall in the bottom face part 23, there are provided three projections 23*c* as a locating means in disposing the light source 40. By aligning the hole parts 43 of the LED substrate 41 and the hole parts 61 of the non-conductive sheet 60 with these projections 23*c* so as to be fitted thereto, the light source 40 can be easily disposed in a predetermined location. At this time, there is no need for bonding the LED substrate 41 and the non-conductive sheet 60 to each other, and the non-conductive sheet 60 to the inner face of the bottom wall of the bottom face part 23.

Next, as shown in FIG. 16D, in the inside of the case 20, the lens body 50 is disposed on the light source 40 from thereabove so as to be superimposed one upon another. As shown in FIG. 2, the lens body 50 has leg parts 55, by which the front face part 52 of the lens body 50 is supported in a predetermined location of the lamp chamber. The LED substrate 41 also has hole parts 44 into which the tips of the leg parts 55 are fitted to be located, whereby the lens body 50 can also be easily disposed in a predetermined location in the lamp chamber. Herein, the lens body 50 is not required to be bonded to any other components.

By the way, the lens body 50 has a predetermined orientation in which it is to be assembled with the case 20. Then, the lens body 50 and the case 20 are provided with a means for regulating the orientation in which they are to be assembled with each other. In other words, in FIG. 1, in any orientation in which the notch 51*a* in the lens body 50 is not aligned to the projection 22*a* in the case 20, the projection 22*a* will interfere with the outer periphery of the substrate 51, thus preventing assembling one with another. Thereby, the proper orientation of the lens body 50 with respect to the case 20 can be easily identified, whereby assembling in a wrong orientation can be avoided.

Next, as shown in FIG. 16E, the packing 70 is disposed along the outer periphery of the front face part 52 of the lens body 50 to assemble the packing 70 with the lens body 50. Then, finally, as shown in FIG. 16F, the cover 30 is combined with the case 20 in such a way that it covers the front face part 52 of the lens body 50 from above. Herein, the inner peripheral wall surface of the peripheral wall 31 of the cover 30 is covered by the outer peripheral wall surface of the peripheral wall 21 of the case 20, the inner peripheral wall surface and the outer peripheral wall surface each having the above-mentioned tapered shape. Accordingly, simply by bringing the opening parts 22, 32 close to each other in a coaxial direction so as to be aligned with each other, the cover 30 and the case 20 can be easily assembled to each other, being guided by the tapered shape.

In this way, when the case 20 and the cover 30 are combined with each other, the engaging part 34 of the cover 30 can be snap-fitted into the engaged part 24 of the case 20 to thereby fix the case 20 and the cover 30 to each other. Accordingly, in assembly, there is no need for using a fixing means such as an adhesive or screw, and the structures of the case 20 and the cover 30 themselves allow the case 20 and the cover 30 to be assembled with ease. Specifically, once the tip of the claw as the engaging part 34 rides on the outer peripheral wall surface of the peripheral wall 21 of the case 20, it is elastically deformed toward the outside while smoothly sliding on the outer peripheral wall surface of the peripheral wall 21. Then, finally, the tip of the claw is fitted into the groove as the engaged part 24, thereby the engaging part 34 and the engaged part 24 being snap-fitted to each other.

In this way, simply by making an operation of aligning the opening parts 22, 32 of the case 20 and the cover 30 with each other, with no need for any extra work, such as deforming the engaging part 34 separately, the snap-fitting engagement can be completed of itself following the above-mentioned operation. Moreover, the lens body 50 is held in the state in which the front face part 52 thereof is pressed against the front face part 33 of the cover 30, thereby the lens body 50 pressing the light source 40 against the inner wall of the bottom face part 23 of the case 20 through the four leg parts 55.

In other words, the case 20 and the cover 30 being fixed to each other by the snap-fitting engagement will accompany the lens body 50, the light source 40, and the like, being held in a predetermined location in the lamp chamber. Therefore, in assembling the respective components, there is no need for using an adhesive, screw, or the like for fixing them. In addition, the front face part 52 of the lens body 50 closes the irradiation aperture 33*a*, being matched thereto, and thus there is no need for separately preparing a clear protection cover, or the like, that covers the irradiation aperture 33*a*, whereby the number of components can be reduced. In this way, the modular lighting unit 10 can be easily assembled due to its simple structure, whereby the cost can be substantially reduced.

In addition, in the present embodiment, the case 20 and the cover 30 are formed into a shape having an octagonal cross section as a whole, and of the eight side face walls of the respective peripheral walls 21, 31 that line up in a peripheral direction, two pairs of side face walls that are opposite to each other are provided with an engaging part 34 or an engaged part 24, respectively. Especially, two pairs of the engaging part 34 and the engaged part 24, rather than a single pair, are provided, being disposed at predetermined intervals in a peripheral direction, whereby a sufficiently high fixing strength can be provided. In addition, the engaging parts 34 are provided along the end edge of the opening part 32 of the cover 30, while the engaged parts 24 are provided along the outer periphery of the bottom face part 23 of the case 20; therefore the engaging parts 34 and the engaged parts 24 can be easily formed in the respective desired locations, and they are free from the possibility of interfering any other components.

If a plurality of modular lighting units 10 as described above are used, it is possible to arrange and dispose them in a shape according to a desired illumination design to implement lighting fittings having various illumination designs. Therefore, diversification of the illumination design of the lighting fitting can be easily accommodated, whereby the number of variations in design shape of the lighting fitting can be increased. With such a configuration of lighting fitting, the light distribution patterns of the individual modular lighting units 10 become important, however, with the present invention, for each particular modular lighting unit 10, the light having a desired light distribution pattern can be obtained through the lens body 50.

In this way, a plurality of types of lens bodies 50 that emit the light originated from the LED 42 in different light distribution patterns may be previously prepared and an appropriate one may be selected from among them. For example, as described above, if there are prepared two different types of lens bodies, i.e., a lens body 50A for distance irradiating and a lens body 50B for adjacency irradiating, modular lighting units 10 including these two types of lens bodies 50 can be freely combined to implement a lighting fitting according to a desired light distribution pattern easily.

Figure 18:
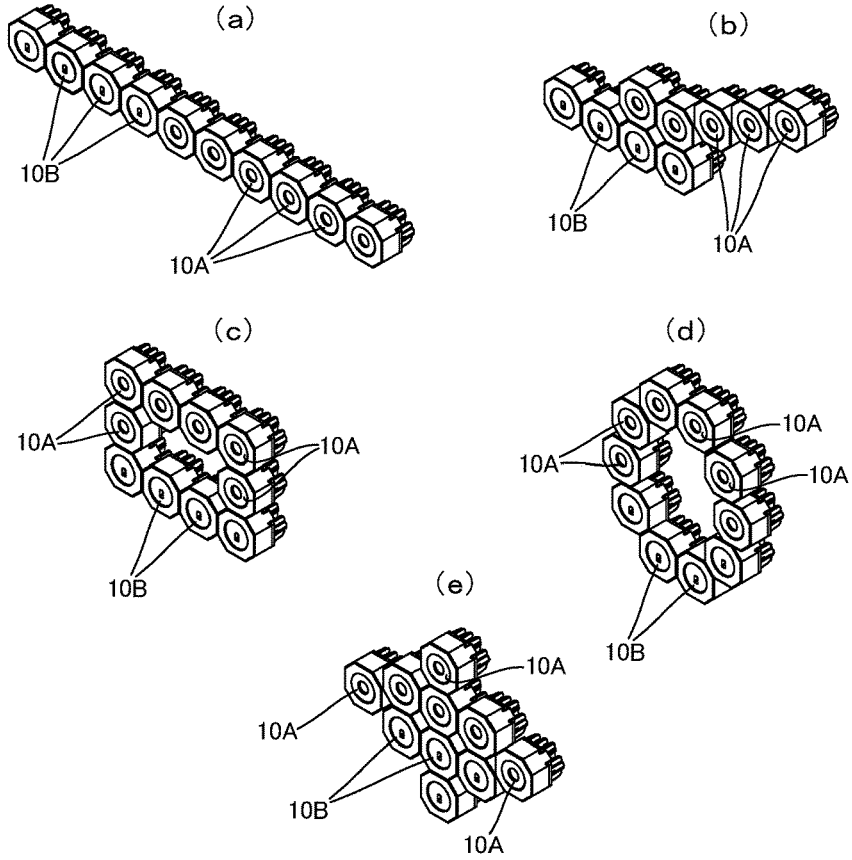
FIG. 18 is an explanatory drawing giving examples of disposition of the modular lighting unit according to an embodiment of the present invention.

FIG. 18 shows examples of arrangement of a plurality of modular lighting units 10. In the present embodiment, the cross sectional shape of each modular lighting unit 10 is octagonal, whereby the respective side wall faces, which are flat, can be abutted against one another such that they are freely arranged in a vertical, horizontal, or oblique direction, being disposed to be tightly adjacent to one another at an equal pitch. In addition, the front face part 52 of the lens body 50 forms an irradiating face, which is circular and has a size large enough to locate the irradiating face close to the peripheral wall 31, and thus, although the cross section of the peripheral wall 31 is octagonal, the peripheral wall 31 seems to be circular when viewed from a distance, thus giving no uncomfortable feeling.

Figure 19:
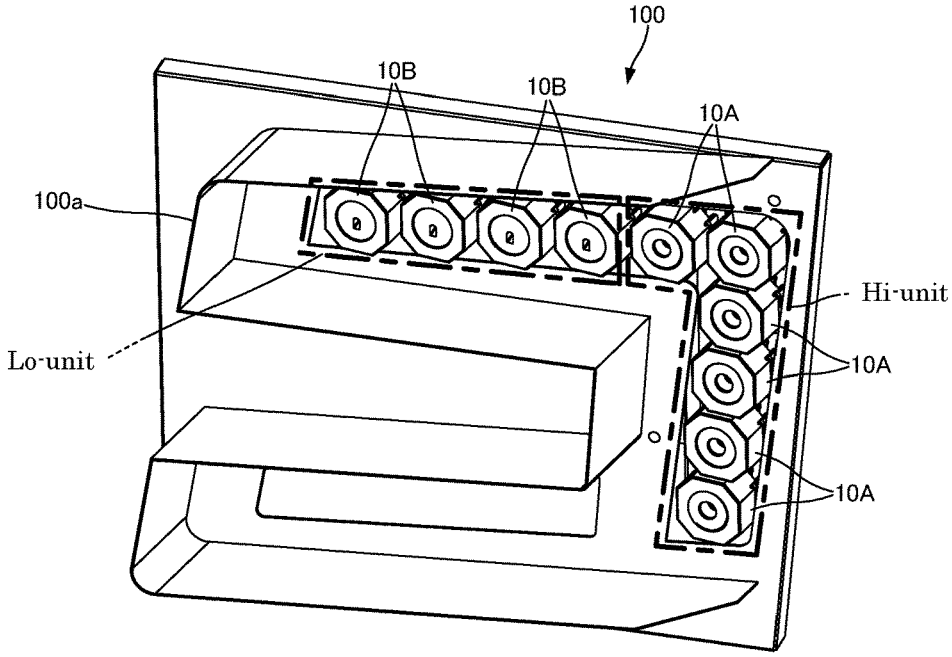
FIG. 19 is a perspective side view of a headlight that is composed of modular lighting units according to an embodiment of the present invention.
Figure 20:
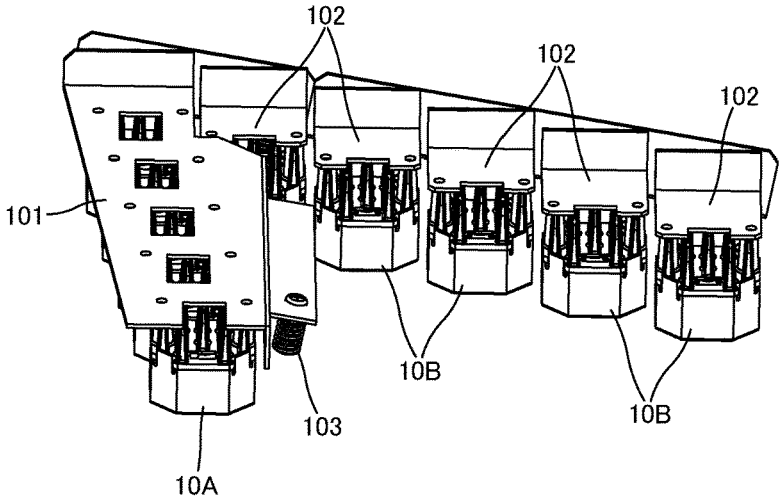
FIG. 20 is a perspective side view showing the rear face of the headlight that is composed of modular lighting units according to an embodiment of the present invention.
Figure 21:
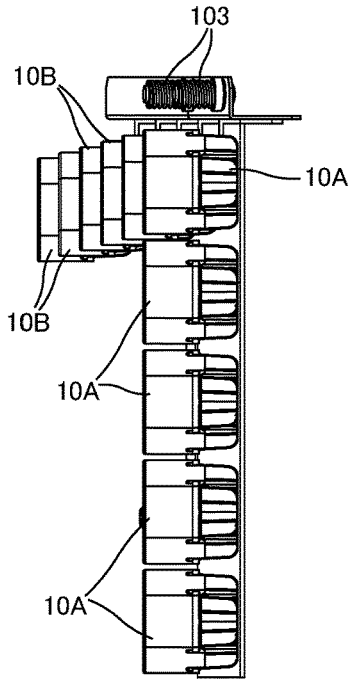
FIG. 21 is a side view showing the side face of the headlight that is composed of modular lighting units according to an embodiment of the present invention.

FIG. 19 to FIG. 21 give an example in which a plurality of modular lighting units 10 have been used to constitute a headlight 100 that is to be disposed in the front part of a railroad vehicle. In the front part of a railroad vehicle, there is provided a housing part 100*a* for the headlight 100 that is designed accordingly to a three-dimensional geometry of the external wall of the front part of the railroad vehicle, and in this housing part 100*a*, a plurality of modular lighting units 10 are disposed. For the headlight 100, in order to realize the light distribution characteristics thereof, it is required to combine the distance irradiation with the adjacency irradiation.

Therefore, the modular lighting units 10 of the headlight 100 are made up of a combination of two different types of modular lighting units, i.e., the modular lighting units 10A that are provided with a lens body 50A for distance irradiating and the modular lighting units 10B provided with a lens body 50B for adjacency irradiating, and the modular lighting units 10A and the modular lighting units 10B constitute a separate unit, respectively, (i.e., a Hi unit and a Lo unit in FIG. 19). With such a configuration, the value of the ratio between the number of modular lighting units 10A for distance irradiating and that of modular lighting units 10B for adjacency irradiating, and the way of arrangement of them can be altered in accordance with the demand of the user.

In the example shown in FIG. 19, all of the modular lighting units 10A for distance irradiating other than one that is disposed adjacent to the modular lighting unit 10A at the top are disposed such that they are arranged in a vertical direction on the same plane of a single support bracket 101. The modular lighting unit 10A that is disposed adjacent to the modular lighting unit 10A at the top and all of the modular lighting unit 10B for adjacency irradiating are disposed through a separate support bracket 102, respectively, such that they are arranged in a horizontal direction three-dimensionally rather than on the same plane, being displaced in a crosswise direction and a vertical direction.

With the present invention, it is also possible to make such a three-dimensional arrangement. Further, the mounting angle of the support bracket 101 can be adjusted in an appropriate manner by means of an optical axis adjusting screw 103. In addition, the respective modular lighting units 10 are supplied with power by an external power supply, being configured so as to be individually controlled for lighting, flashing, illumination, and the like, with the use of a control means.

Heretofore, the embodiment of the present invention has been described with reference to the drawings, however, the specific configuration is not limited to that of the above-described embodiment, and various changes and modifications may be included in the present invention, so long as they do not depart from the spirit and scope thereof. For example, with the above-described embodiment, the geometry of the entire modular lighting unit 10 has been assumed to be that having an octagonal cross section, however, it may be that with any other polygonal cross section, such as a triangle, square, hexagonal, or the like.

In addition, it has been assumed that the cover 30 is provided with an engaging part 34, and the case 20 is provided with an engaged part 24, however, as an aspect reverse to that of the above-described embodiment, the cover 30 may be provided with an engaged part 24, and the case 20 may be provided with an engaging part 34. Herein, the engaging part 34 is not limited to that which is claw-like, and the engaged part 24 is not limited to that which is groove-like, a claw-like component being fitted thereinto.

Furthermore, as the light emitting element for the light source 40, the LED 42 has been adopted, however, a lamp, or the like, may be adopted as the light emitting element. Needless to say, the LED 42 is not limited to the surface mounting type LED chip, and an LED lamp that is made up of an LED chip imbedded in a shell-like molding.

The application for the modular lighting unit according to the present invention is not limited to headlights for railroad vehicles, and it is also applicable to, for example, braking lamps, auxiliary lamps (fog lamps), side marker lamps (small lamps), direction indicators (winkers), and the like, and besides such illumination lighting fittings for vehicles, it is widely applicable to illumination apparatuses for home use, advertisements, and the like.

DESCRIPTION OF SYMBOLS

Reference numeral 10 denotes a modular lighting unit; 20 a case; 21 a peripheral wall; 22 an opening part; 23 a bottom face part; 24 an engaged part; 30 a cover; 31 a peripheral wall; 32 an opening part; 33 a front face part; 33*a* an irradiation aperture; 34 an engaging part; 40 a light source; 41 an LED substrate; 42 an LED; 43 a hole part; 44 a hole part; 50 a lens body; 51 a substrate; 52 a front face part; 54 a top end part; 55 a leg part; 60 a non-conductive sheet; 61 a hole part; 70 a packing; 100 a headlight; and 100*a* a housing part.

What is claimed is:

1. A modular lighting unit, comprising one light emitting element disposed in a lamp chamber that is enclosed by a case and a cover, said case and said cover being combined with each other in such a way that a peripheral wall of said cover covers a peripheral wall of said case, and in a mutually combined state, being fixed to each other with an engaging part provided in one of the case and the cover being engaged with an engaged part provided in the other of the case and the cover by snap fitting, in a front face part of said cover, there being formed an irradiation aperture for irradiating light originated from said light emitting element, between said light emitting element and said irradiation aperture, there being disposed a lens body that distributes the light made incident from said light emitting element thereon in a previously designed range or a predetermined direction, a front face part of said lens body closing said irradiation aperture, being matched thereto, said lens body being held in a state in which a front face part thereof is pressed against a front face part of said cover, thereby said lens body pressing said light emitting element against a bottom face part of said case, and said cover being fitted to the case to assemble together the case, the cover, the light emitting element, and the lens body without a fixing member.

2. The modular lighting unit according to claim 1, wherein said lens body is selected from a plurality of types of lens bodies, the lens bodies emitting light originated from the light emitting element in different light distribution patterns.

3. The modular lighting unit according to claim 1, wherein the orientation in which said lens body is to be assembled, upon being disposed in said case, is predetermined, and in said lens body and said case, there is provided with an orientation regulating means for regulating the orientation in which assembling of one with the other is performed.

4. The modular lighting unit according to claim 1, wherein an annular packing formed of an elastic material is interposed between an inner circumferential edge of said irradiation aperture in a front face part of said cover and the front face part of said lens body, said cover and said lens body being tightly contacted with each other through said packing.

5. The modular lighting unit according to claim 1, wherein, along an end edge of the opening part located at a rear end of the peripheral wall of said cover, there are provided a plurality of said engaging parts at predetermined intervals, along the outer periphery of a bottom face part on the side opposite to an opening part located at the front end of the peripheral wall of said case, a plurality of said engaged parts being provided in locations corresponding to those of said respective engaging parts.

6. The modular lighting unit according to claim 1, wherein the respective peripheral walls of said case and said cover are formed into a shape of a polygonal cross section, and of a plurality of side face walls that line up in a peripheral direction, a pair of side face walls that are opposite to each other are provided with an engaging part or an engaged part.

7. The modular lighting unit according to claim 1, wherein an outer peripheral wall surface of the peripheral wall of said case has a tapered shape with which a diameter is gradually reduced from the bottom face part located at the rear end toward the opening part thereahead, while the inner peripheral wall surface of the peripheral wall of said cover has a tapered shape with which the diameter is gradually increased from the front face part, where the light originated from said light emitting element is irradiated, to the opening part therebehind, by bringing the respective opening parts close to each other, said case and said cover being assembled to each other, being guided by said tapered shape.

8. The modular lighting unit according to claim 1, wherein said cover is provided with an engaging claw as said engaging part, and said case is provided with an engaged groove as said engaged part into which a tip of said engaging claw is fitted, said engaging claw being provided with a tapered shape that allows said claw to be slid on an outer peripheral wall surface of the peripheral wall of the case, being elastically contacted therewith, until fitted into said engaged groove.

9. The modular lighting unit according to claim 1, wherein said light emitting element is one light emitting diode (LED) that is mounted on a LED substrate, on an inner face of a bottom wall in a bottom face part of said case, there being provided a locating means for properly locating the LED substrate upon disposing said LED substrate in the bottom face part.

10. The modular lighting unit according to claim 9, wherein, between the inner face of the bottom wall in the bottom face part of said case and said LED substrate, there is interposed a non-conductive sheet made up of an insulating material, the non-conductive sheet being also located together with said LED substrate with the use of said locating means.

* * * * *